US009421593B2

(12) United States Patent
Alken et al.

(10) Patent No.: US 9,421,593 B2
(45) Date of Patent: Aug. 23, 2016

(54) METHOD AND DEVICE FOR COOLING SURFACES IN CASTING INSTALLATIONS, ROLLING INSTALLATIONS OR OTHER STRIP PROCESSING LINES

(71) Applicant: SMS Siemag AG, Duesseldorf (DE)

(72) Inventors: Johannes Alken, Siegen (DE); Torsten Mueller, Kreuztal (DE); Thomas Haschke, Bad Berleburg (DE)

(73) Assignee: SMS GROUP GMBH, Duesseldorf (DE)

( * ) Notice: Subject to any disclaimer, the term of this patent is extended or adjusted under 35 U.S.C. 154(b) by 0 days.

(21) Appl. No.: 14/410,641

(22) PCT Filed: Jul. 1, 2013

(86) PCT No.: PCT/EP2013/063866
§ 371 (c)(1),
(2) Date: Apr. 9, 2015

(87) PCT Pub. No.: WO2014/006008
PCT Pub. Date: Jan. 9, 2014

(65) Prior Publication Data

US 2015/0239027 A1 Aug. 27, 2015

(30) Foreign Application Priority Data

Jul. 2, 2012 (DE) ..... 10 2012 211 454

(51) Int. Cl.
*B21B 45/02* (2006.01)
*B21B 27/10* (2006.01)

(52) U.S. Cl.
CPC ..... *B21B 45/0233* (2013.01); *B21B 27/10* (2013.01); *B21B 45/0218* (2013.01); *B21B 2027/103* (2013.01)

(58) Field of Classification Search
CPC B21B 27/10; B21B 45/0233; B21B 45/0215; B21B 45/0209; B21B 45/0203; B21B 45/02; B21B 2027/103
See application file for complete search history.

(56) References Cited

U.S. PATENT DOCUMENTS 4,226,108 A * 10/1980 Wilmotte ..... B21B 27/10 72/201
5,265,441 A 11/1993 Kramer
(Continued)

FOREIGN PATENT DOCUMENTS

DE 2751013 5/1979
DE 19718530 11/1998
(Continued)

*Primary Examiner* — Shelley Self
*Assistant Examiner* — Mohammad Yusuf
(74) *Attorney, Agent, or Firm* — Abelman, Frayne & Schwab

(57) ABSTRACT

The invention relates to a method for to-be-cooled surface of cast material, rolled material (1) or a roll. Provided for the method is a nozzle, which comprises an inlet (3) and an outlet (5) lying opposite the surface to be cooled. Also provided is a preferably single-phase volume flow (V) of a cooling fluid, which is fed to the nozzle (2) via the inlet (3) and leaves the nozzle (2) through the outlet (5). According to the invention, the nozzle outlet (5) is mounted at a variable distance (d) from the surface to be cooled, wherein the volume flow (V) of the cooling fluid fed to the inlet (3) of the nozzle (2) is set in such a way that, in accordance with the Bernoulli principle, the nozzle (2) is sucked firmly against the surface (1) to be cooled. In addition, the invention is directed to a cooling device (10) for carrying out the method according to the invention and to a rolling device comprising this cooling device (10).

18 Claims, 3 Drawing Sheets

(56) References Cited

U.S. PATENT DOCUMENTS

| | | | | |
|---|---|---|---|---|
| 5,878,966 | A * | 3/1999 | Asakawa | B05B 1/00 239/589 |
| 8,499,410 | B2 | 8/2013 | Yoshimura | |
| 2013/0249150 | A1* | 9/2013 | Matsumoto | B21B 39/16 266/114 |

FOREIGN PATENT DOCUMENTS

| | | |
|---|---|---|
| DE | 10207584 | 9/2003 |
| EP | 1775034 | 4/2007 |
| JP | 57156830 | 9/1982 |
| JP | 06088134 | 3/1994 |
| JP | 07088554 | 4/1995 |
| JP | 07284820 | 10/1995 |
| JP | 11244928 | 9/1999 |
| JP | 2003-285114 | * 10/2003 |
| JP | 2005118838 | 5/2005 |
| SU | 1386324 | 4/1988 |
| SU | 1588781 | 8/1990 |

* cited by examiner

METHOD AND DEVICE FOR COOLING SURFACES IN CASTING INSTALLATIONS, ROLLING INSTALLATIONS OR OTHER STRIP PROCESSING LINES

RELATED APPLICATIONS

This application is a National Stage application of International application PCT/EP2013/063866 filed Jul. 1, 2013 and claiming priority of German application DE 10 2012 211 454.8 filed Jul. 2, 2012. Both applications are incorporated herein by reference thereto.

SUBJECT OF THE INVENTION

The present invention relates to a method of and a device for cooling surfaces in casting installations, rolling installations, or similar strip processing lines. Here, advantageously, a cooling medium is applied to a surface of cast stock or rolling stock; in particular, a metal strip or sheet, or a roll.

STATE-OF-THE-ART

State-of-the art discloses a plurality of methods for cooling metal strips or rolls.

German Publication DE 41 16 019A discloses, e.g., a device for cooling a metal strip with nozzles which are arranged on opposite sides of the metal strip and which are formed as full jet nozzles. These nozzles produce vertical streams, wherein rings are formed about a strike point of a separate vertical stream in the region of the striking flow. With this device, the jets are not limited by any guide or limitation on the strip surface. The drawbacks of such a device consists, e.g., in a relative large water consumption and, despite the undertaken efforts, in very difficult avoidance of a detrimental damping layer between the striking flow and the to-be-cooled surface.

German Publication DE 27 51 013 A1 discloses a cooling device that produces a spray containing water droplets and applied to a to-be-cooled metal plate. The necessary nozzles are formed as Venture tubes through which a predetermined mixture of air and water is advanced. The resulting multiphase cooling flow leads to formation of a damping layer highly detrimental to the cooling effect.

Japanese Publication JP 2005-118838 discloses a cooling device with spray nozzles. The spray nozzles produce a jet consisting of liquid and gaseous components. This likewise produces a damping layer on the to-be-cooled material which is detrimental to effective cooling.

The object of the invention is an improved method for cooling cast stock, rolling stock, or rolls.

Preferably, the object is at least to prevent the above-mentioned drawbacks.

It is particularly preferable to reduce the amount of the cooling means and/or to provide an efficient, effective, and/or flexible cooling.

DESCRIPTION OF THE INVENTION

The technical object is achieved by features of independent claim 1. According to the claimed method, for cooling a surface of cast stock, rolling stock (in particular metal strip or sheet) or a roll, there is provided a nozzle having an inlet with a first inner cross-section and an outlet facing the to-be-cooled surface and having a second inner cross-section which is preferably greater that the first cross-section. Further, there is provided a preferably single-phase cooling fluid fed to the nozzle through its inlet and which leaves the nozzle through the outlet. At least the nozzle outlet or the nozzle itself is supported at a variable (freely adjustable) distance from the to-be-cooled surface. The volume flow which is fed to the nozzle inlet is so adjusted that the nozzle or the nozzle outlet is aspirated (automatically) toward the to-be-cooled surface according to the Bernoulli principle (or hydrodynamic paradox).

The support of the nozzle with a variable or freely adjustable distance from the to-be-cooled surface, and the adjustment of the volume flow of the cooling fluid that flows through the nozzle so that it is firmly or tightly automatically aspirated to the surface according to the Bernoulli principle, enable an effective cooling of the surface. In accordance with the above-mentioned principle, during the flow of the cooling fluid (e.g., water, air, or emulsion of water and oil) out of the nozzle outlet, a lower pressure (under-pressure) in comparison with the nozzle environment is generated, which leads to attraction of the nozzle to the to-be-cooled surface or, in other words, the distance between the nozzle outlet and the surface is independently reduced. This can be caused, e.g., by a high flow velocity of the stream that flows out of the nozzle outlet, whereby according to the Bernoulli principle, the pressure of the fluid that flows out of the nozzle diminishes. The pressure diminishing in the flow region between the to-be-cooled surface and the nozzle outlet leads to a condition in which the nozzle is aspirated toward the to-be-cooled surface due to the pressure difference with respect to the pressure of the nozzle environment. However, the nozzle does not collide with the to-be-cooled surface because the volume and flow is (constantly) supplied and resupplied through the nozzle inlet. Thus, at a preferably constant volume flow, essentially, a uniform distance between the nozzle outlet and the surface is insured. This distance is self-regulated, in other words, the distance is self-adjusted.

The nozzle is displaceably supported at a distance relative to the surface that lies, preferably, in a range between 0.1 mm and 5 mm and, advantageously, in a range between 0.5 mm and 2 mm.

Further advantages of the invention include high heat transfer coefficients between the to-be-cooled surface and the nozzle and an increased efficiency in comparison with existing systems. In addition, the length of the cooling device for cooling a strip can be reduced in the strip running direction due to the increased efficiency. In particular, the cooling means can be applied at a particular point so that, on one side, separate regions of the to-be-cooled surface can be specifically cooled and, on the other side, loss of the cooling means is prevented. Besides, the nozzle isolates the stray cooling medium from the specific cooling zone. Thus, the cooling efficiency of the nozzle is independent to a most possible extent from the stray cooling means. If a plurality of nozzles are distributed over the roll or strip width, separate sections of the roll or the strip can be either cooled to a lesser extent or not cooled at all, with the nozzles in these sections being shut off.

According to an advantageous embodiment of the method, the distance between the outlet (exclusively) and the to-be-cooled surface varies essentially in a transverse direction toward the to-be-cooled surface. This means that the distance is not limited to a particular size. The distance is adjusted by the volume flow.

According to a further advantageous embodiment of the method, the nozzle is at least partially slidably supported in a guide. As a guide, e.g., a slide bearing can be used, wherein the nozzle is slidably displaceably supported in a bearing sleeve. The bearing can be so arranged that the movement takes place in the direction transverse to the to-be-cooled surface. This insures a most possible force-free self-adjustment of the distance between the nozzle outlet and the to-be-cooled surface.

According to a still further advantageous embodiment of the invention, the nozzle is supported resiliently and/or additionally with a damping device. Preferably, the nozzle is supported transverse to the to-be-cooled surface under pre-stress. It is possible to cool the surface with one or more nozzles. In this case, the pre-stress support of the nozzles is particular advantageous because, on one hand, the to-be-cooled surface, i.e., the roll or the cast stock can be properly displaced and, on the other hand, self-adjustment of the distance between the nozzle and the to-be-cooled surface is possible. Such nozzles can be provided on both the upper surface of the metal strip or sheet and the lower surface.

According to a further advantageous embodiment of the method, the nozzle is oscillatingly displaced substantially parallel to the to-be-cooled surface, in particular, by an oscillating device. Such cooling can overcome a non-uniform cooling of the surface. In particular, a larger surface can be covered with a limited number of nozzles. The oscillation has at least one component acting transverse to the strip running direction or parallel to an axial direction of a roll. Preferably, oscillation takes place parallel to the plane of the to-be-cooled surface. With an arrangement with several nozzles, those can oscillate in different directions and with different frequencies.

According to a yet further advantageous embodiment of the method, the nozzle has a guide region provided between the inlet and the outlet and in which the cooling fluid flows from the inlet to the outlet in the direction extending substantially transverse to the to-be-cooled surface and is sidewise enclosed thereby. In other words, the volume flow from the outlet is guided substantially transverse to its cross-section. This permits to prevent, in particular during use of the cooling fluid, undesirable turbulences which can cause blow holes. Thus, by preventing blow holes, heat transfer between the cooling fluid and the to-be-cooled surface can be noticeably improved.

According to a still further embodiment of the method, the cross-section of the nozzle outlet increases in the direction of the to-be-cooled surface. The spreading or widening shape of the outlet in the direction of the to-be-cooled surface permits to deflect portions of the cooling medium flow in the horizontal direction. Such a shape permits to increase the suction effect. Preferably, the above-mentioned widening is bent constantly and/or, e.g., funnel-like or outwardly.

According to another embodiment of the method, the second cross-section is formed rotationally symmetrical in a plane extending parallel to the to-be-cooled surface. In other words, the cross-section can be essentially circular. Such formation permits to achieve a homogenous supply of the cooling means.

According to yet another embodiment of the method, the nozzle is not formed rotationally symmetrically in the plane extending parallel to the to-be-cooled surface. It is formed so that it is elongated, in particular, elliptical. With this feature, e.g., an asymmetrical cooling zone can counteract to the displacement of the to-be-cooled surface.

According to a still another embodiment of the method, adjustment of the volume flow comprises adjustment of a flow velocity and/or its pressure. The exact values of the pressure or the volume flow depends on the geometry and size of the nozzle.

According to a further embodiment of the method, the variable distance between the outlet and the to-be-cooled surface is maintained by a limiting element (independent from the available volume flow) greater than 0.1 mm and, preferably, greater than 0.5 mm. Such a limiting element or stop can prevent a collision of the nozzle with the to-be-cooled surface, e.g., in case of drop of the volume flow.

According to another embodiment of the method, several nozzles are arranged in a grid-like manner in a plane opposite the to-be-cooled surface. The grid-like arrangement of nozzles permits to cover a larger region of the to-be-cooled surface. In other words, a plurality of nozzles are arranged next to each other opposite the to-be-cooled surface. I.e., a plurality of nozzles can be arranged in a row, e.g., of more than four nozzles. In case of cooling a roll, advantageously, several nozzles can be arranged in a direction extending parallel to the roll axis. Generally, several such rows can be provided. In case of cooling a roll or cast stock, such as a metal strip, such rows can extend perpendicular to the strip running direction. In addition, several rows can be arranged one after another in the strip running direction. It is also possible to have the rows offset relative to each other in the direction transverse to the strip running direction, so that, viewing in the strip running direction, in the intermediate space between two adjacent nozzles of one row, nozzles of an adjacent, in the strip running direction, row are located. It is likewise possible to oscillate separate nozzles or nozzle rows in the same or different directions parallel to the to-be-cooled surface in order to obtain as uniform as possible cooling outcome.

According to an embodiment of the method, the outlet of the nozzle is arranged opposite a roll surface or opposite a metal strip surface between two rolling mill stands of a rolling train. In particular, in such positions, the inventive method is particular advantageous.

In addition, the invention is directed to a cooling device for cooling a surface of cast stock, rolling stock, or roll, preferably, for carrying out the method of one of the preceding claims. The cooling device includes at least one nozzle having an inlet with a first inner cross-section and an outlet facing a to-be-cooled surface and having a second inner cross-section greater than the first cross-section, wherein the cooling device is so formed that distance between the outlet of the nozzle and the to-be-cooled surface in direction transverse thereto movably varies between 0.1 mm and 10 mm, preferably between 0.5 mm and 5 mm, and more preferably, between 0.5 mm and 2 mm. In particular, the nozzle can be slidably displaced through a guide.

The invention is further directed to a rolling apparatus for rolling stock, having the above-described device, the rolling apparatus includes at least one roll having a to-be-cooled rolled surface with the outlet of the nozzle being directed for cooling toward the roll surface. Alternatively or in addition, the rolling apparatus includes at least two, arranged next to each other, rolling mill stands for rolling a metal strip, wherein the cooling device is located between the two rolling mill stands for cooling a surface of the metal strip located between the two rolling mill stands.

Further the nozzle is preferably used to achieve the intended production process in the to-be-cooled body (in particular metal strip) at the site of the nozzle.

The features of the described embodiments can be combined with each other or be replaced by each other.

BRIEF DESCRIPTION OF THE DRAWINGS

Below, the drawings of exemplary embodiments will be briefly described. Further detail will be understood from the detailed description of the exemplary embodiments. The drawings show.

DETAILED DESCRIPTION OF EXAMPLARY EMBODIMENTS

Figure 1:
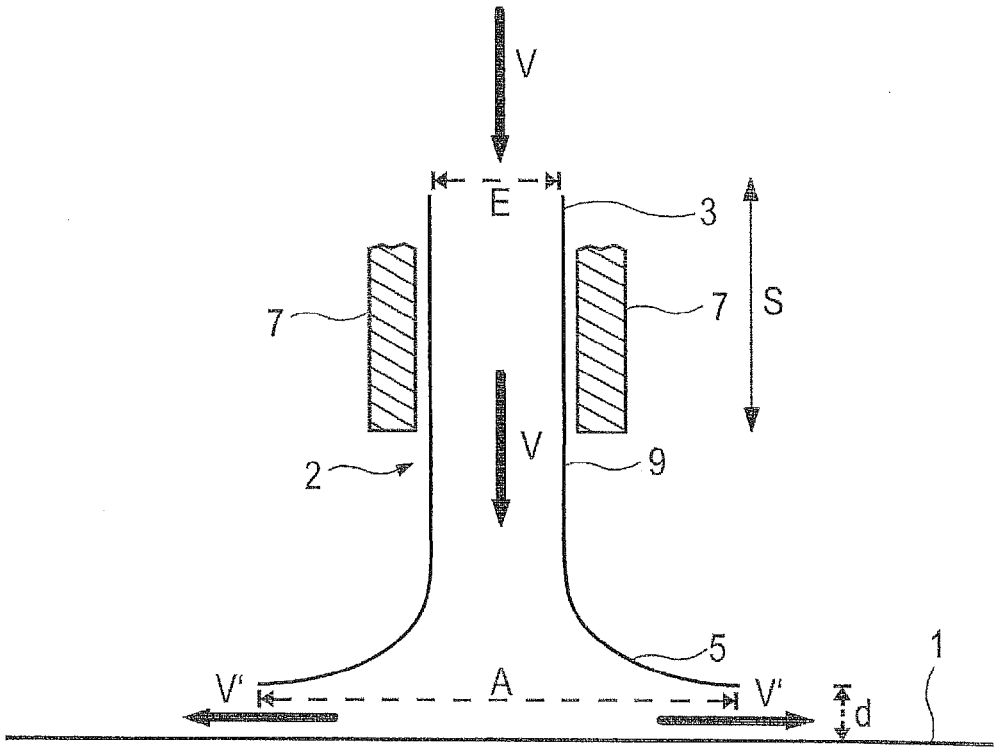
FIG. 1 a schematic cross-sectional view of an exemplary embodiment of a nozzle according to the invention.

FIG. 1 shows a schematic cross-sectional view of an exemplary embodiment of a nozzle 2 for use in a process according to the invention. The nozzle 2 has an inlet 3 and an outlet 5 facing a to-be-cooled surface of a body or a strip 1. Between the inlet 3 and the outlet 5, the nozzle 2 has a guiding region 9 through which a volume flow V which is fed to the inlet 3, flows to the outlet 5. The volume flow V is delivered to the outlet 5 that preferably extends transverse to the to-be-cooled surface. Advantageously, the inlet 3 has a smaller internal diameter or cross-section E than the outlet 5. In other words, the outlet 5 has a greater internal diameter or cross-section A than the inlet region 3 and/or the guide region 9. The nozzle 2 or its outlet 5 widens in direction of the to-be-cooled surface and is preferably displaceably supported in the guide region 9 by a guide element 7, or is so supported relatively to the surface of the to-be-cooled strip 1 that the distance d between the to-be-cooled strip 1 and the outlet 5 of the nozzle 2 is variable. Here, the nozzle 2 preferably slides in the guide 7. This movement takes place advantageously in direction S transverse to the to-be-cooled surface. The guide 7 particularly secures the nozzle 2 against tilting. The volume flow V of the cooling fluid preferably flows through the nozzle outlet 5. As fluid, generally, liquid is used, in particular water or oil-water mixture. Alternatively, cooling with gas, e.g., air or inert gas is also possible. Advantageously, as cooling means, generally, a liquid is used as it permits to obtain a higher heat transfer coefficient than when gases are used.

Advantageously, only a single-phase cooling fluid should be used. With a correspondingly adjusted volume flow V, the nozzle 2 can tightly adhere to the to-be-cooled surface. This takes place, as it has been previously described, according to Bernoulli principle or, using another expression, according to the hydrodynamic paradox. The adjustment can be carried out by adaptation of the pressure or the velocity of the volume flow V fed to the nozzle 2.

One of ordinary skill in the art is familiar with the Bernoulli principle per se. A corresponding effect takes place, e.g., when a passenger car passes a truck. When both vehicles are at the same level, the passenger car is sidewise of the truck, and the passenger car, after passing the truck, moves in a transverse direction again toward its original driving direction.

When the two vehicles pass each other, the constricted and accelerated air stream between the two vehicles creates vacuum. According to the Bernoulli principle, the produced constricted and accelerated air stream results in underpressure between the two vehicles in comparison with the air pressure of the vehicles environment. The explanation should be considered as a clarification, and it should not be viewed as a limitation.

With reference to the invention or to the described embodiment, an underpressure effect takes place when the volume flow $V^1$ that exits the outlet 5 and flows between the outlet 5 and the to-be-cooled surface, reaches a high relative velocity so that the pressure of the volume flow $V^1$ between the outlet 5 and the to-be-cooled surface drops below the pressure of the air surrounding the nozzle 2. The surrounding air pressure can correspond to the atmospheric pressure. With the volume flow V held constant, according to the Bernoulli principle, equilibrium is maintained when the underpressure or suction effect takes place. When a distance d between the to-be-cooled surface and the nozzle outlet changes, the nozzle automatically creates equilibrium corresponding to the distance. Such distance changes can be caused, e.g., by irregularities of the to-be-cooled surface or, e.g., by deformation of the roll surface or a non-uniform displacement of the metal strip 1. Likewise, when a roll is cooled, this can be valid for irregular roll surface.

Generally, the nozzle 2 or the inventive method can be used for cooling the strip upper surface and for cooling the strip lower surface.

Figure 2:
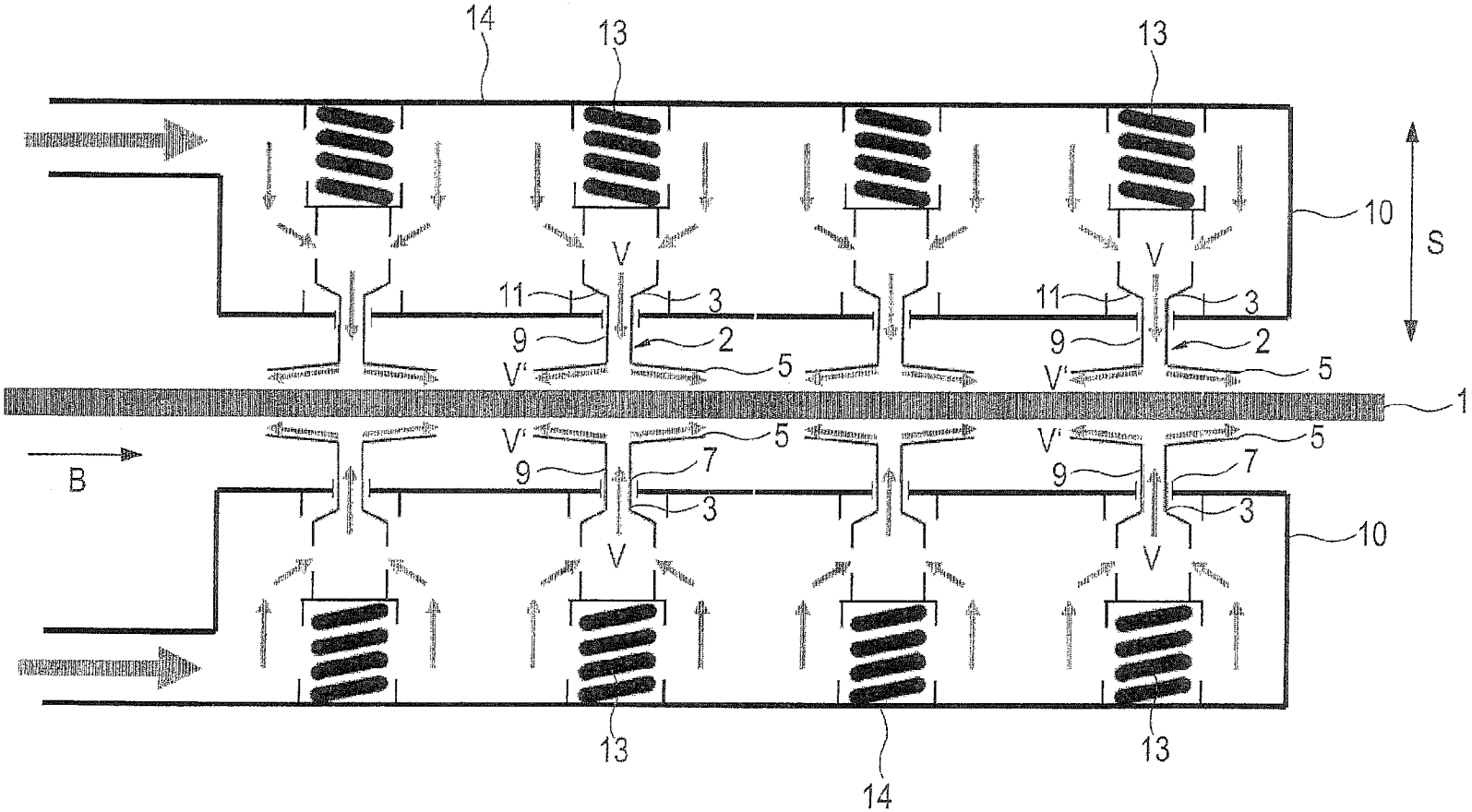
FIG. 2 a schematic cross-sectional view of an exemplary embodiment of a cooling device according to the invention.

FIG. 2 shows a schematic cross-sectional view of an embodiment of a cooling device 10 for cooling the metal strip 1. For simplification, the same or similar elements will be designated with the same reference numerals as in FIG. 1. The device 10 shown in FIG. 2 has a plurality of nozzles 2 which are jointly fed from a cooling fluid container 14. The cooling device 10 is provided, respectively, on the strip upper side and the strip lower side for cooling the metal strip 1. The nozzles 2 are arranged in rows located one behind another in the strip displacement direction B. Each row extends, preferably, transverse to the strip displacement direction B. These rows can be offset transverse to the strip displacement direction so that, viewing in the strip flow directions B, a greater portion of the width of the strip 1 can be covered by nozzles 2 than by one of the rows. The nozzles 2 are fed, respectively, with a volume flow V through the inlet 3 in a manner similar to that shown in FIG. 1. Here, the container 14 can correspondingly be kept under pressure in order to direct the cooling fluid in the inlets 3 of the nozzles 2 under pressure. The nozzles 2 are displaced transverse to the to-be-cooled surface by guide elements 7, e.g., sleeve bearings so that the distance d between the nozzle outlet 5 and the to-be-cooled surface is variable. Nevertheless, the distance d can, e.g., be mechanically limited. To prevent collision with the to-be-cooled surface, the device 10, in particular the nozzles 2 and/or the guide elements 7 have stops 11 which limit the displacement of nozzles 2 in a direction toward the to-be-cooled surface. In addition the nozzles 2 and/or the spring elements 13 can be essentially pre-stressed transverse to the to-be-cooled surface.

Further, it is generally possible that the cooling device 10 includes one or more oscillation devices (not shown) which can be oscillated to oscillate each separate nozzle 2 parallel to the to-be-cooled surface or to oscillate jointly all of the nozzles 2 of the device 10. Preferably, oscillation of the common container 14, together with the nozzles 2 mounted thereon, is also possible.

Figure 3:
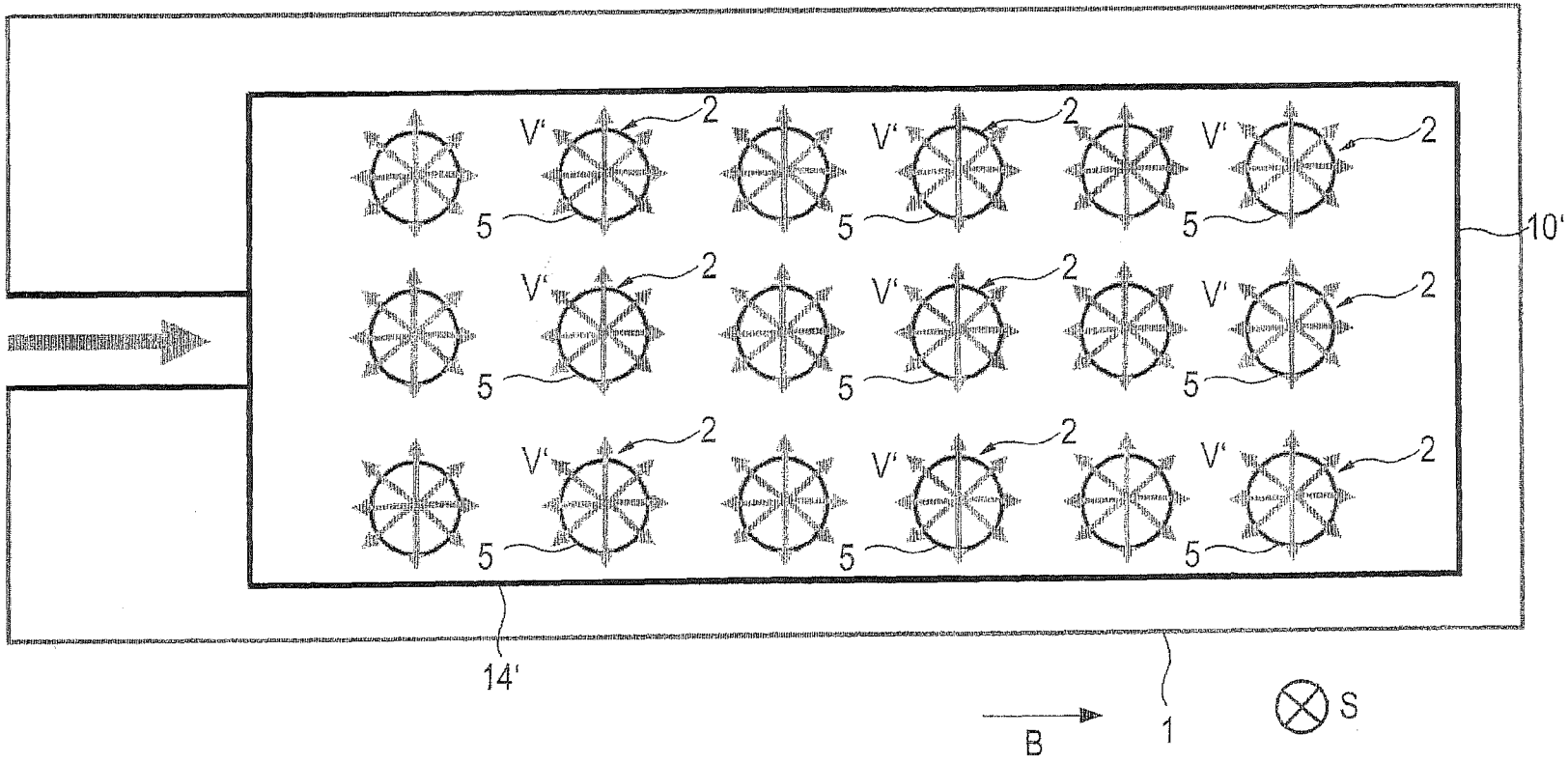
FIG. 3 a partially transparent, schematic plan view of a further exemplary embodiment of a cooling device according to the invention.

FIG. 3 shows a partially transparent plan view of an embodiment of a cooling device 10'. The device 10' substantially corresponding to the device shown in FIG. 2, however, here, six nozzle rows which are arranged one behind the other in the strip displacement direction, are shown. The device according to FIG. 2 has four such rows. The fluid container 14' supplies the nozzles 2 with cooling fluid. The fluid exits the outlet 5 of the nozzles 2 in form of the volume flow $V^1$, so that a heat transfer between the strip 1 and the cooling fluid or the volume flow $V^1$ can take place. As shown in FIG. 3, the volume flow $V^1$ leaves the outlet 5 of the nozzle 2 preferably in direction substantially parallel to the to-be-cooled surface. If the nozzle outlet 5 has the shown rotationally symmetrical or annular shape, the volume flow $V^1$ that leaves the outlet, flows essentially concentrically from the nozzle 2.

Generally, the inventive nozzle 2 can have different forms, e.g., slotted or round forms. When the nozzle has a slotted form, the nozzle 2 can extend at least over a portion of the width of the to-be-cooled surface, as over the width of the roll or the metal strip.

Generally, the cross-section of the nozzle 2 or the nozzle outlet 5 can be adapted likewise to an asymmetrical working region produced by movement towards the to-be-cooled surface.

The inner diameter of the nozzle outlet can lie advantageously between 0.5 cm and 10 cm, preferably, between 1 cm and 5 cm.

In case of cooling with gas, e.g., air or inert gas, the distance between the outlet 5 of the nozzle 2 and the to-be-cooled surface can amount, e.g., to between 0.1 mm and 5 mm or, preferably, to between 0.1 mm and 3 mm.

In case of cooling with liquid, e.g., water, water mixture, or emulsion, the distance between the outlet 5 of the nozzle 2 and the to-be-cooled surface amounts to, e.g., between 0.5 mm and 5 mm, preferably, between 1 mm and 5 mm, or even between 1 mm and 2 mm.

The distances which are smaller than listed above, as a rule, have no advantages, because in such a case, there is an increased danger of collision between the to-be-cooled surface and the nozzle 2. Such a collision can lead to damage of the nozzle 2 or the to-be-cooled surface.

In case several nozzles are located opposite the to-be-cooled surface, advantageously, they may have distances one beneath the other that would correspond to from 0.5 times to 5 times, preferably form 1 time to 2 times of the inner diameter of the outlet 5.

The above-described embodiments serve for a better understanding of the invention and should not be understood as limiting. The scope of protection of the present application is defined by the claims.

The features of the described embodiments can be combined with each other or replace each other.

Further, the described features can be adapted to the existing conditions and requirements.

LIST OF REFERENCE CHARACTERS

1 Rolling stock, cast stock, metal strip or sheet
2 Nozzle
3 Inlet
5 Outlet
7 Guide
9 Guide region
10 Cooling device
10' Cooling device
11 Limiting element
13 Pre-stress element/spring element/damping element
14 Fluid container
14' Fluid container
A Outlet cross-section
B Strip displacement direction
E Inlet cross-section
S Direction transverse to to-be-cooled surface
V Volume flow of cooling medium
$V^1$ Volume flow exiting the nozzle outlet
d distance from the nozzle to the to-be-cooled surface

The invention claimed is:

1. A method of cooling a surface of cast stock, rolling stock (1), or roll, comprising the following steps:

providing a nozzle (2) having an inlet (3) and an outlet (5) located opposite a cooled surface;

providing a single-phase volume flow (V) of a cooling fluid fed to the nozzle (2) via the inlet (3) and that leaves the nozzle through the outlet (5), characterized in that, at least the nozzle outlet (5) is supported at a variable distance (d) to the cooled surface; and the volume flow (V) of the cooling fluid fed to the inlet (3) of the nozzle (2) is so freely self-adjusted that the nozzle (2) is aspirated toward the cooled surface according to Bernoulli principle.

2. A method according to claim 1, wherein the distance (d) between the outlet (5) and the cooled surface varies in a direction (S) extending transverse to the cooled surface.

3. A method according to claim 1, wherein the nozzle (2) is slidably supported in a guide (7).

4. A method according to claim 1, wherein the nozzle (2) is essentially supported transverse to the cooled surface under pre-stress.

5. A method according to claim 1, wherein a cross-section (A) of the outlet (5) is rotationally symmetrical in a plane extending parallel to the cooled surface or, alternatively, in order to counteract the influence of a movable cooled surface, is formed elongated and substantially elliptical.

6. A method according to claim 1, wherein the nozzle (2) is displaced oscillatingly substantially parallel to the cooled surface.

7. A method according to claim 1, wherein several nozzles or rows of nozzles (2) are oscillatingly displaced parallel to the cooled surface, and the oscillation of adjacent nozzles (2) or nozzle rows takes place in a same direction or an opposite direction.

8. A method according to claim 1, wherein the nozzle (2) has a guide region (9) provided between the inlet (3) and the outlet (5) and in which the cooling fluid flows from the inlet (3) to the outlet (5) in the direction (S) extending transverse to the cooled surface and is sidewise enclosed thereby.

9. A method according to claim 1, wherein a cross-section (A) of the outlet (5) widens in a downstream direction continuously.

10. A method according to claim 1, wherein adjustment of the volume flow comprises adjustment of at least one of flow velocity and its pressure.

11. A method according to claim 1, wherein the variable distance (d) between the outlet (S) and the cooled surface is retained, independently from an available volume flow (V), by a limiting element (11) greater than 0.09 mm and than.

12. A method according to claim 1, wherein the volume flow (V) is formed by liquid.

13. A method according to claim 1, wherein the outlet (5) of the nozzle (2) is arranged opposite a roll surface or opposite a metal strip surface between two rolling mill stands of a rolling train.

14. A method according to claim 1, wherein several nozzles (2) are arranged in a row one behind another in a plane opposite the cooled surface, or several nozzles are arranged, respectively, in several adjacent rows opposite the cooled surface.

15. A cooling device (10) for cooling a surface of cast stock, rolling stock, or roll comprising:

at least one nozzle (2) having an inlet (3) with a first inner cross-section (E) and an outlet (5) facing a cooled surface and having a second inner cross-section (A) greater than the first cross-section (E), wherein the cooling device (10) is so formed that in a direction transverse to the cooled surface, distance (d) between the outlet (5) of the nozzle (2) and the cooled surface is freely self-adjusted between 0.1 mm and 5 mm according to the Bernoulli principle.

16. A rolling apparatus for rolling stock, comprising at least one cooling device (10) for cooling a surface of cast stock, rolling stock, or roll and having at least one nozzle (2) having an inlet (3) with a first inner cross-section (E) and an outlet (5) facing a to-be-cooled surface and having a second inner cross-section (A) greater than the first cross-section (E), wherein the cooling device (10) is so formed that in a direction transverse to the cooled surface, distance (d) between the outlet (5) of the nozzle (2) and the cooled surface is freely self-adjusted between 0.1 mm and 5 mm according to Bernoulli principle, wherein the rolling apparatus includes at least one roll having a cooled roll surface, and the outlet (5) of the nozzle (2) is directed for cooling toward the roll surface, or wherein the rolling apparatus comprises at least two, arranged next to each other, rolling mill stands for rolling a metal strip (1), and the cooling device (10) is located between the two rolling mill stands for cooling a surface of the metal strip located between the two rolling mill stands.

17. A cooling device (10) according to claim 15, wherein the distance (d) between the outlet (5) of the nozzle (2) and the cooled surface is self-adjusted between 0.5 mm and 2 mm.

18. A method according to claim 9, wherein the variable distance (d) between the outlet (S) and the cooled surface is retained, independently from an available volume flow (V), by a limiting element (11) greater than 0.5 mm.

* * * * *